US005360285A

United States Patent [19]

Barth et al.

[11] Patent Number: 5,360,285

[45] Date of Patent: Nov. 1, 1994

[54] SET OF SHAPED STONES AND SHAPED STONE FOR PAVING GROUND AREAS WITH WIDE GAPS THEREBETWEEN

[75] Inventors: Günther Barth, Bühlertal; Fritz von Lansdorff; Harald von Langsdorff, both of Rastatt, all of Germany

[73] Assignee: F. von Langsdorff Licensing Limited, Mississauga, Canada

[21] Appl. No.: 854,663

[22] PCT Filed: Oct. 26, 1990

[86] PCT No.: PCT/EP90/01919

§ 371 Date: May 4, 1992

§ 102(e) Date: May 4, 1992

[87] PCT Pub. No.: WO91/06706

PCT Pub. Date: May 16, 1991

[30] Foreign Application Priority Data

Nov. 2, 1989 [DE] Germany ..... 3936527

[51] Int. Cl.[5] ..... E01C 5/00

[52] U.S. Cl. ..... 404/37; 404/42

[58] Field of Search ..... 404/42, 41, 37, 38, 404/39

[56] References Cited

U.S. PATENT DOCUMENTS

| | | | |
|---|---|---|---|
| 4,185,939 | 1/1980 | Barth et al. | 404/38 |
| 4,834,575 | 5/1989 | Barth et al. | 404/41 X |

FOREIGN PATENT DOCUMENTS

| | | | |
|---|---|---|---|
| 2259493 | 6/1974 | Germany . | |
| 2841261 | 4/1980 | Germany . | |
| 8013891 | 8/1980 | Germany . | |
| 3303210 | 8/1984 | Germany | 404/42 |
| 3303225 | 8/1984 | Germany . | |
| 3722683 | 1/1989 | Germany . | |
| 8901920 | 7/1989 | Germany . | |
| 3804760 | 8/1989 | Germany . | |

OTHER PUBLICATIONS

Betonwerk+Fertigteil-Technik, Heft Feb. 1979, pp. 71-74 "Technischer Stand der Einbauformen für Betonsteinfertigungsautomaten" (Moulds for automatic block machines-today's state of technics), Rodon Sickerfahige Belage, Jun. 1989, p. 356.

*Primary Examiner*—William P. Neuder

*Attorney, Agent, or Firm*—Spencer, Frank & Schneider

[57] ABSTRACT

A set of shaped stones for paving ground areas with wide gaps between the shaped stones is provided which comprises first and second shaped stones, with the second shaped stones having a smaller plan view area than the first shaped stones. A plurality of integral spacing projections are provided on the periphery of only one of the first and second shaped stones for defining the wide gaps in the shaped stone pavement.

27 Claims, 3 Drawing Sheets

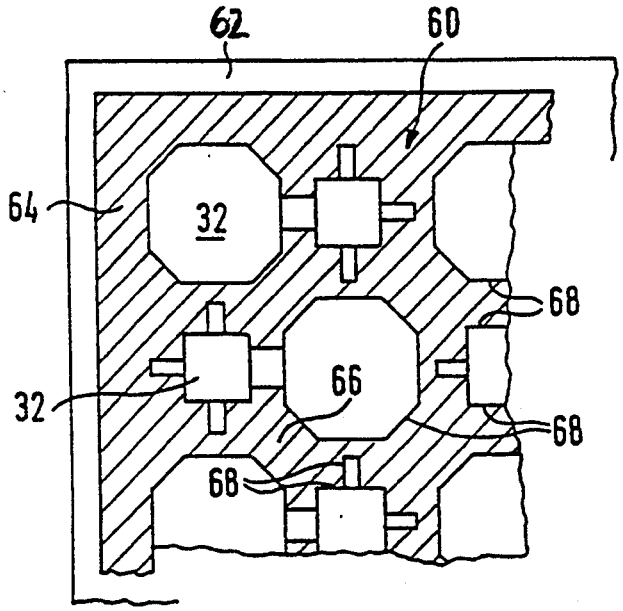
FIG. 6
FIG. 5
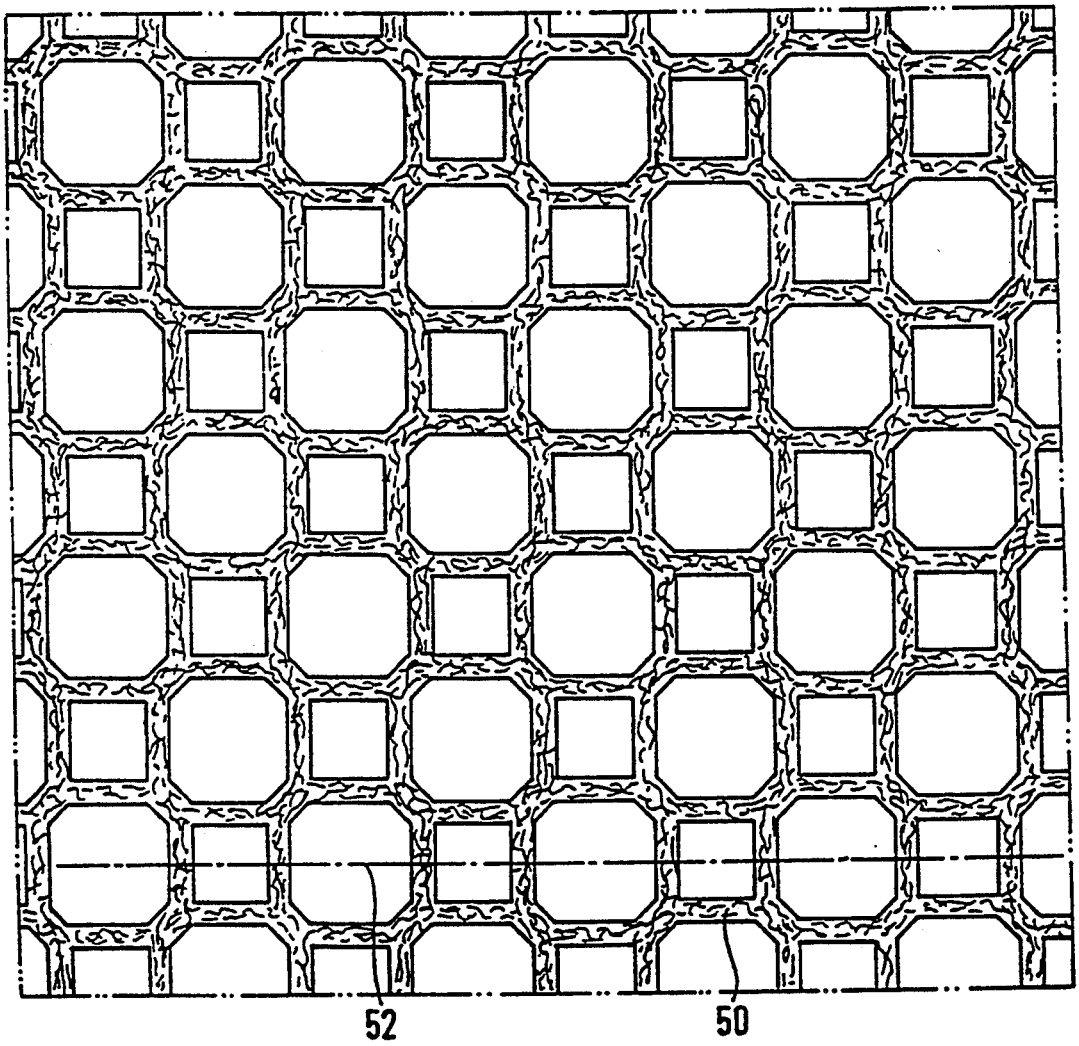

SET OF SHAPED STONES AND SHAPED STONE FOR PAVING GROUND AREAS WITH WIDE GAPS THEREBETWEEN

The invention relates to a set of shaped stones and to a shaped stone for paving ground areas with wide gaps between the shaped stones.

Such shaped stones are frequently referred to as "lawn paving stones". They have spacing projections on the periphery thereof, so that comparatively wide gaps between the stones are created in the paved area. These gaps can be filled with soil, and grass may grow in these wide soil-filled gaps. The paved area thereby is given a pleasing, natural appearance, while the area covered therewith is nevertheless paved and can be driven on by vehicles. As an alternative thereto, it is possible to fill the wide gaps for instance with relatively coarse sand or fine gravel or stone chips. The result is in both cases that surface water at least to a large extent enters into the spaces between the stones and need not be discharged along the surface of the paved area into a drain channel.

The lawn paving stones described must be distinguished from so-called lawn grid plates which have inner openings or perforations for creating grass growth at these locations.

The set of shaped stones according to the invention comprises first shaped stones, and second shaped stones having a smaller plan view area than the first shaped stones, and a plurality of integral spacing projections for defining the wide gaps in the shaped stone pavement provided on the periphery of only one of the first and second shaped stones.

A ground area paved with the shaped stones of the shaped stone set presents a lively, pleasing appearance, since there is no monotonous repetition of one single format of shaped stones. The wide gaps do not extend rectilinearly or—for instance because of a non-rectilinear stone contour—in only slightly deviating manner from rectilinearity, but rather, gaps are obtained which are considerably laterally offset in their outline pattern. This enhances the paved ground area as regards the capability thereof of being driven on, which is of particularly great significance in view of the wide gaps. Furthermore, the set of shaped stones can be manufactured more easily and less expensively, since only one of the two kinds of shaped stones is provided with the spacing projections that are more difficult to manufacture.

According to a further aspect of the invention, a shaped stone according to the invention comprises at least one first partial shaped stone, at least one second partial shaped stone having a smaller plan view area than the first partial shaped stone, and connected to the first partial shaped stone by a material bridge integral with the partial shaped stones, and a plurality of integral spacing projections for defining the wide gaps provided on the periphery of only one of the two partial shaped stones.

In a ground area paved with this shaped stone, the same advantages result as regards appearance and gap pattern as those elucidated hereinbefore for the set of shaped stones according to the invention. As regards improved manufacturing possiblities, the afore-mentioned advantage also is present for the most part, since an essential part of the periphery of the shaped stone does not have spacing projections.

With regard to the preferred embodiments of the invention described hereinafter in further detail, the term "different configuration of the two shaped stones or partial shaped stones, respectively" is to be understood as a difference in configuration exceeding the aforementioned difference in size of the plan view areas. While the invention in its broadest form covers also first shaped stones and partial shaped stones, respectively, and second shaped stones and partial shaped stones, respectively, of equal geometrical configuration, for instance a larger square with a smaller square, a larger hexagon with a smaller hexagon, a larger octagon with a smaller octagon, a larger circle with a smaller circle, the development mentioned is directed to an alternation in the geometrical basic configuration.

When the first shaped stone or partial shaped stone is an octagon and the second shaped stone or partial shaped stone is a square, the lateral length of the square preferably is substantially identical with the length of that side of the octagon which faces the square—possibly in the laid condition.

The dimensioning of the length of the spacing projections for the set of shaped stones is such that when a second shaped stone is placed centrally beside a first shaped stone, the outline of both stones can be circumscribed in plan view by a common outline rectangle touching the first shaped stone at three sides thereof and touching the ends of the spacing projections not immediately adjacent to the first shaped stone. The dimensioning of the spacing projection for the shaped stone is similar, in that the shaped stone can be circumscribed in plan view by an outline rectangle touching the first partial shaped stone at three sides thereof and touching the ends of the spacing projections.

The dimensioning of the length of the spacing projections leads to the effect that, despite the difference in size of the plan view area between the first shaped stone or partial shaped stone and the second shaped stone or partial shaped stone, straight confining lines are formed in a paved ground area or in a group of juxtaposed shaped stones. The latter effect is of significance since a group of shaped stones thus can be conveniently and safely lifted off by means of mechanical clamping grippers and at the same time can be laid in mechanical manner.

The term "parallel to the useful side" in claims 8 and 18 is to comprise also that borderline case that the spacing projections or the material bridge, respectively, extend on their top side at the same height level in alignment with the useful side.

It is pointed out that the shaped stone according to the invention also may have several first partial shaped stones and several second partial shaped stones, so that, for instance, integral assemblies of 4, 6, 8 etc. partial shaped stones can be formed.

It is pointed out, furthermore, that the shaped stone set according to the invention and the shaped stone according to the invention, respectively, may also have more than two shaped stone formats and partial shaped stone formats, respectively, for instance three or four different formats.

The shaped stone set according to the invention and the shaped stone according to the invention, respectively, preferably consist of concrete, but may also consist of other suitable materials that are adapted to be moulded in their raw state, such as for instance brick material, sand-lime material etc.

The subject matter of the invention further concerns a metallic manufacturing mould for simultaneously making a plurality of shaped stones of concrete on the table of a manufacturing machine for making shaped concrete stones, characterized in that the manufacturing mould comprises such shaping areas that it forms shaped stones of the type described in the application.

Finally, the subject matter of the invention is a ground area pavement of shaped stones with wide gaps between the shaped stones, comprising several rows of adjacently placed shaped stones, characterized in that first shaped stones and second shaped stones of the type described in the application alternate with each other in progressing manner in the direction of the rows as well as transversely of the direction of the rows.

The invention and developments of the invention will be elucidated in more detail hereinafter by way of preferred embodiments shown in the drawings in which:

FIG. 4 shows a perspective view of the shaped stone of

FIG. 5 shows a section of a ground area paved with sets of shaped stones according to FIGS. 1/2 and with shaped stones according to FIGS. 3/4, respectively;

FIG. 6 shows a horizontal sectional view of a manufacturing mould.

Figure 1:
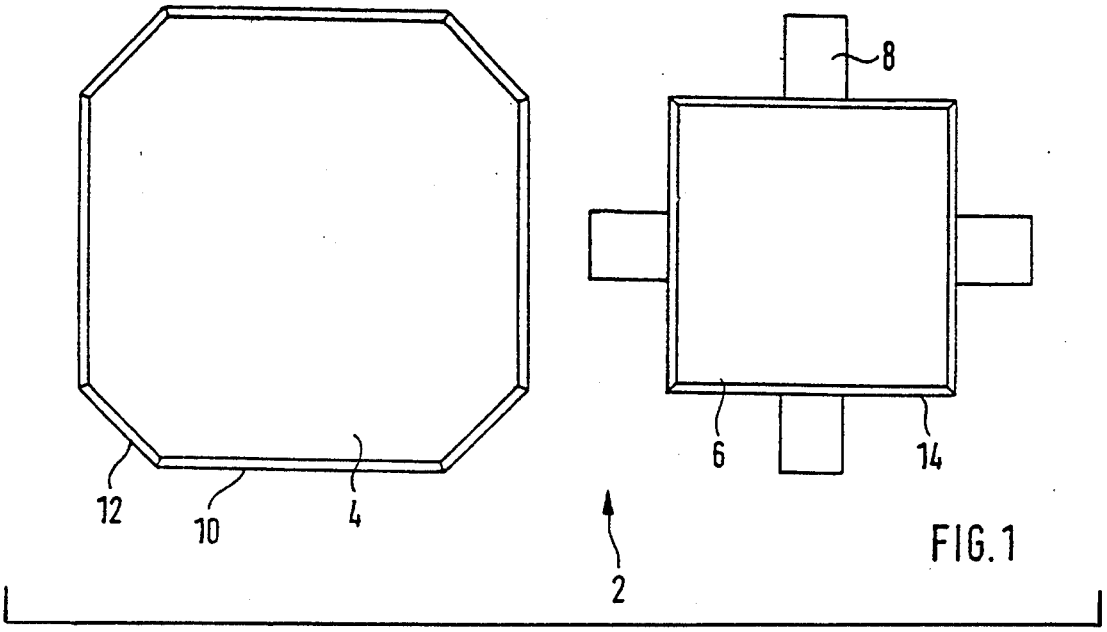
FIG. 1 shows a plan view of a set of shaped stones.
Figure 2:
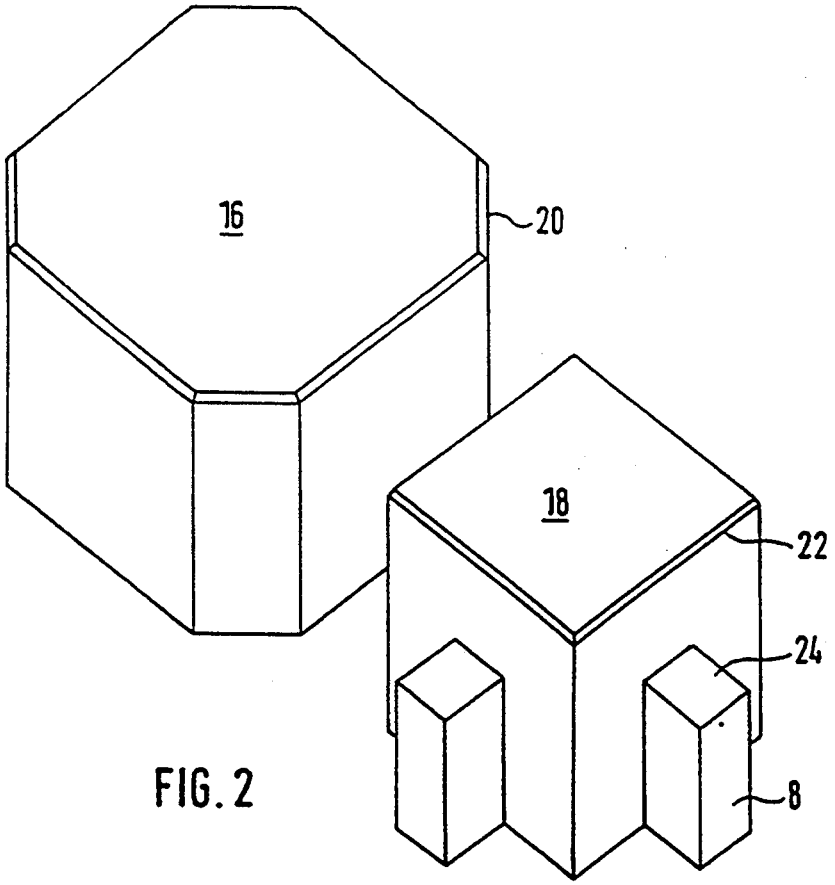
FIG. 2 shows a perspective view of the set of shaped stones of FIG. 1.

The shaped stone set 2, i.e. set of shaped stones, depicted in FIGS. 1 and 2 consists of a first shaped stone 4 which is octagonal in plan view, and of a second shaped stone 6 which is square in plan view and has a rectangular spacing projection 8 on each side of the square. The octagonal plan view of the first shaped stone 4 is centrally symmetrical, with longer sides 10 of the octagon alternating with shorter sides 12 of the octagon. The sides 14 of the plan view square of the second shaped stone 6 have substantially the same length as the longer sides 10 of the first shaped stone 4.

For ease of understanding, the first shaped stone 4 and the second shaped stone 6 are drawn in FIGS. 1 and 2 with a free space therebetween. It is understood that the shaped stones for paving a ground area are laid so closely placed together that the end of a spacing projection 8 abuts on the centre of a longer side 10 of the first shaped stone 4.

It can be seen in FIG. 2 that the first shaped stone 4 and the second shaped stone 6 have a bevel 20 and respectively, extending along the edge of their respective plan view areas or top sides 16 and 18. Furthermore, one can see that the top sides 24 of the spacing projections 8 extend below the level of top sides 16 and 18, and are also parallel thereto. Instead of the parallel extension, it may also be provided in particular that the top sides 24 are slanted downwardly and outwardly or extend in alignment with the useful side 18 or that the top sides 24 are shaped in the manner of a gable roof having a ridge line extending radially outwardly from the centre of the second shaped stone 6.

When, with reference to FIG. 1, the second shaped stone 6 is shifted toward the first shaped stone 4, one can easily imagine an outline rectangle circumscribing the entire shaped stone set 2, which in the present embodiment is a double-square outline rectangle. The latter extends along three of the four longer sides 10 at the periphery of first shaped stone 4, and, at the second shaped stone 6, touches the ends of three of the four spacing projections 8. The shaped stone set 2 or a group of several of such shaped stone sets 2 can thus be easily and safely gripped in clamping manner by a mechanical clamping gripper having rectilinear clamping jaws.

A possible variant consists in designing also the second shaped stone 6 with beveled corners in plan view so that it constitutes so-to-speak a version of the first shaped stone 4 which is reduced in plan view area. Furthermore, it is alternatively possible to provide the spacing projections 8 on the first shaped stone 4 instead of on the second shaped stone 6. These variants are also possible with the shaped stones according to FIGS. 3 and 4 in analogous manner.

The integral shaped stone 32 according to FIGS. 3 and 4 differs from the shaped stone set according to FIGS. 1 and 2 in the following respect:

(a) Instead of the first shaped stone 4 and the second shaped stone 6, there are provided a first partial shaped stone 34 and a second partial shaped stone 36 which are integrally joined together via a material bridge 38 (instead of the spacing projection 8 directed to the left in FIG. 1);

(b) the material bridge 38 as seen in plan view, and as measured in a direction parallel to facing sides of the first and second partial shaped stones (34,36), is of greater width than the width three remaining spacing projections 8.

Reference is made to the fact that the variants of-the top side design of the spacing projections 8, described in connection with the first embodiment according to FIGS. 1 and 2, are applicable here, too, in analogous manner for the top side design of the material bridge 38. In the embodiment depicted in FIGS. 3 and 4 the material bridge 38 is of lesser width than the length of a square side of the second partial shaped stone 36. As an alternative, it is possible to give the material bridge 38 a width corresponding to the length of this square side. Furthermore, it is possible to provide several material bridges 38 beside each other.

Figure 3:
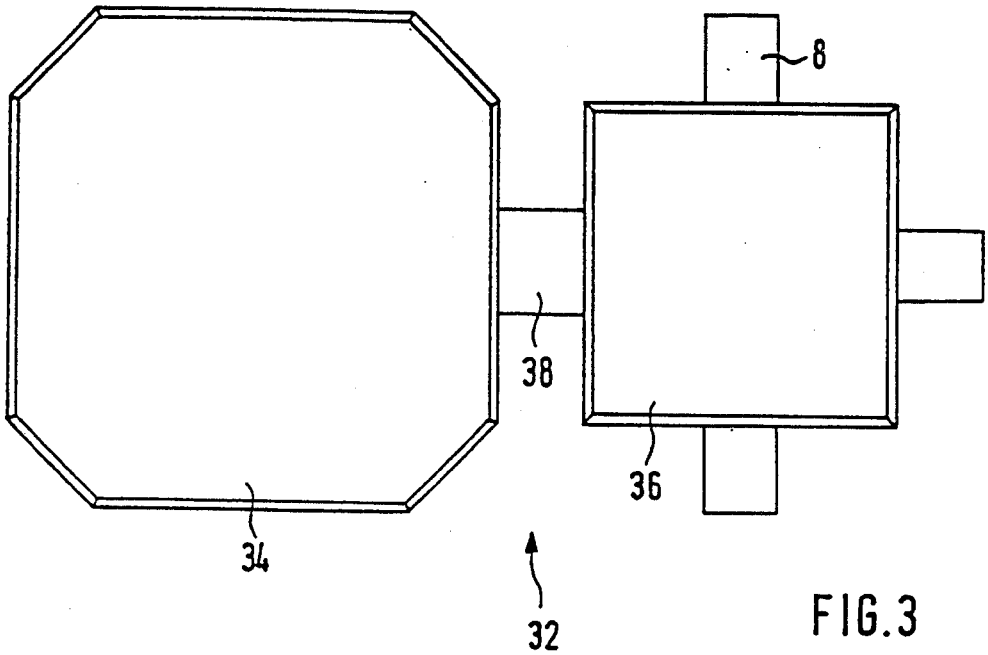
FIG. 3 shows a plan view of a shaped stone.
Figure 4:
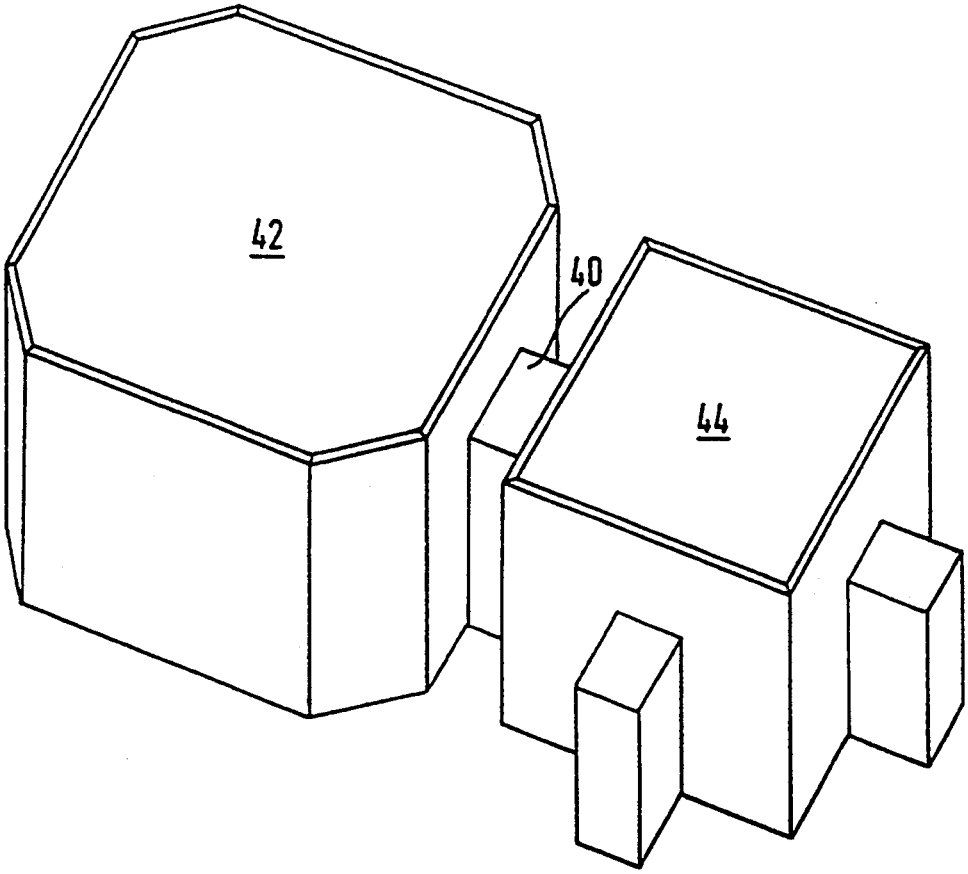

The paving pattern of FIG. 5 is formed when a ground area is paved either with shaped stone sets according to FIGS. 1 and 2 or with shaped stones according to FIGS. 3 and 4. Between the shaped stones and the partial shaped stones, respectively, there are formed wide gaps 50 having essentially the same width in the entire pavement. Due to the fact that the spacing projections 8 or material bridges 38, respectively, terminate at their top sides below the level of the useful surface of the shaped stones and partial shaped stones, respectively, the spaces above the spacing projections 8 and material bridges 38, respectively, are also filled with soil or permeable filling material, so that the spacing projections 8 and the material projections 38, respectively, are not visible any more. Grass growth in the gaps 50 is indicated in outline in the drawings. One can see that octagonal, larger stone shapes regularly alternate with square, smaller stone shapes, both in the progression along a row 52 in horizontal direction in FIG. 5 and in the direction at right angles thereto, that is, along corresponding columns. Each square stone shape is surrounded on the four sides thereof by four octagonal stone shapes; each octagonal stone shape is surrounded on four sides thereof by square stone shapes (when disregarding that the shorter sides of the octagon are located opposite "diagonally" adjacent octagonal stone shapes). Finally, it is perceivable that the gaps 50, when progressing horizontally or vertically in FIG. 5, follow a considerably laterally staggered path, so that the wheels of vehicles, for instance passenger vehicles, do not come into positions in which they rest on gap edges only. Rather, adjacent gap portions are offset to such an extent that the wheel concerned always rests on useful stone sides as well.

FIG. 6 shows a corner region section of a manufacturing mould 60, in a horizontal sectional view, for making a plurality of shaped stones 32 according to FIGS. 3 and 4 on a horizontal table 62 of a manufacturing machine for making shaped stones of concrete. For the purpose of illustration, the drawing shows a shaped stone 32 to be manufactured in the associated shaping area at the upper left of FIG. 6. A further shaped stone 32 to be manufactured is shown therebelow, the upper shaped stone 32 having the first partial shaped stone 34 in the associated first shaping area oriented towards the left, and the further shaped stone 32 having its first partial shaped stone 34 oriented towards the right. Additional adjacent shaped stones 32 to be manufactured are shown in fragmentary manner. Second partial shaped stones 36 to be manufactured are shown in the associated second shaping areas, as seen in FIG. 6.

In the manufacturing mould 60 drawn in hatched manner, one can distinguish a mould frame 64 that is closed all around, and inner mould portions 66 contiguous with the mould frame 64. The manufacturing mould 60 either is a construction of parts welded together, or it is burned out from solid material by means of a laser beam. The inner wall of the mould frame 64 and the inner mould portions 66 are designed such that shaping areas 68 are formed in accordance with the shaped stones 32 to be manufactured. The top sides of the spacing projections 8 and of the material bridges 38 as well as the useful sides 42, 44 of the shaped stones 32 are formed by a shaping die, not shown, which is movable up and down and which is urged from above into the concrete material in the still soft state thereof.

It is easy to conceive of analogous manufacturing moulds 60, which are designed for simultaneously making a plurality of first shaped stones 4 or second shaped stones 6 on the table of a manufacturing machine for making shaped stones of concrete.

We claim:

1. A set of shaped stones for paving ground areas with wide gaps between the shaped stones, comprising:
- first shaped stones;
- second shaped stones having a smaller plan view area than said first shaped stones; and
- a plurality of spacing projections provided integrally with only one of said first and second shaped stones for defining the wide gaps in a shaped stone pavement.

2. A set of shaped stones according to claim 1, wherein only the second shaped stones are provided with said spacing projections.

3. A set of shaped stones according to claim 1, wherein only the first shaped stones are provided with said spacing projections.

4. A set of shaped stones according to claim 1, wherein the first shaped stones and the second shaped stones have different configurations.

5. A set of shaped stones according to claim 1, wherein the first shaped stones, as seen in plan view, are octagons.

6. A set of shaped stones according to claim 5, wherein said first shaped stones, as seen in plan view, are centrally symmetrical octagons with four longer and four shorter sides.

7. A set of shaped stones according to claim 1, wherein the second shaped stones, as seen in plan view, are squares.

8. A set of shaped stones according to claim 2, wherein the spacing projections on the second shaped stones project to such an extent that, when the second shaped stone is placed centrally beside the first shaped stone, said second shaped stone and said first shaped stone can be circumscribed in plan view by a common outline rectangle touching the first shaped stone at three sides thereof and touching ends of the spacing projections not immediately adjacent said first shaped stone.

9. A set of shaped stones according to claim 1, wherein said spacing projections have top sides located at a lower level than a top side of an associated stone.

10. A set of shaped stones according to claim 1, wherein said spacing projections have top sides that are parallel to a top side of an associated shaped stone.

11. A set of shaped stones according to claim 1, wherein said spacing projections have top sides that are slanted downwardly and outwardly with respect to a top side of an associated shaped stone.

12. A set of shaped stones according to claim 1, wherein said spacing projections have top sides having a gable roof configuration.

13. A shaped stone for paving ground areas with wide gaps between the shaped stones, comprising:
- a first partial shaped stone;
- a second partial shaped stone having a smaller plan view area than said first partial shaped stone;
- a material bridge integrally connecting said second partial shaped stone to said first partial shaped stone; and
- a plurality of spacing projections integrally provided on the periphery of only one of the two partial shaped stones for defining the wide gaps in a shaped stone pavement.

14. A shaped stone according to claim 13, wherein said spacing projections are provided on the periphery of only the second partial shaped stone.

15. A shaped stone according to claim 13, wherein the first partial shaped stone and the second partial shaped stone have different configurations.

16. A shaped stone according to claim 13, wherein the first partial shaped stone, as seen in plan view, is octagonal.

17. A shaped stone according to claim 16, wherein the first partial shaped stone, as seen in plan view, is centrally symmetrically octagonal with four longer and four shorter sides.

18. A shaped stone according to claim 13, wherein the second partial shaped stone, as seen in plan view, is square.

19. A shaped stone according to claim 14, wherein the spacing projections on the second partial shaped stone project to such an extent that the shaped stone can be circumscribed in plan view by an outline rectangle touching the first partial shaped stone at three sides thereof and touching the ends of said spacing projections.

20. A shaped stone according to claim 13, wherein said material bridge,as seen in plan view, and as measured in a direction parallel to facing sides of said first and second partial shaped stones, is of a smaller width than a width of any of said facing sides.

21. A shaped stone according to claim 20, wherein said material bridge, as seen in plan view, and as measured in a direction parallel to facing sides of said first and second partial shaped stones is of greater width than the width of said spacing projections.

22. A shaped stone according to claim 13, wherein said material bridge, as seen in plan view, and as measured in a direction perpendicular to facing sides of said first and second partial shapes stones, has substantially the same length as said spacing projections.

23. A shaped stone according to claim 13, wherein said spacing projections and/or said material bridge have top sides located at a lower level than a top side of an associated shaped stone.

24. A shaped stone according to claim 13, wherein said spacing projections and/or said material bridge have top sides that are parallel to a top side of an associated shaped stone.

25. A shaped stone according to claim 13, wherein said spacing projections and/or said material bridge have top sides that are slanted downwardly and outwardly with respect to a top side of an associated shaped stone.

26. A shaped stone according to claim 13, wherein said spacing projections and/or said material bridge have top sides having a gable roof configuration.

27. A ground area pavement of shaped stones comprising: first shaped stones, second shaped stones having a smaller plan view area than said first shaped stones, and a plurality of spacing projections provided integrally with only one of said first and second shaped stones for defining wide gaps between said shaped stones in said ground area pavement, wherein said ground area pavement is composed of rows and columns of shaped stones where said first shaped stones alternate with said second shaped stones.

* * * * *